US009604379B2

(12) United States Patent
Klockow

(10) Patent No.: US 9,604,379 B2
(45) Date of Patent: Mar. 28, 2017

(54) DICING MACHINES AND METHODS OF USE

(71) Applicant: Urschel Laboratories Inc., Valparaiso, IN (US)

(72) Inventor: Scott Alan Klockow, Kouts, IN (US)

(73) Assignee: Urschel Laboratories, Inc., Chesterton, IN (US)

( * ) Notice: Subject to any disclaimer, the term of this patent is extended or adjusted under 35 U.S.C. 154(b) by 294 days.

(21) Appl. No.: 14/285,075

(22) Filed: May 22, 2014

(65) Prior Publication Data

US 2014/0345432 A1 Nov. 27, 2014

Related U.S. Application Data

(60) Provisional application No. 61/826,585, filed on May 23, 2013.

(51) Int. Cl.
*B26D 3/22* (2006.01)
*B26D 7/18* (2006.01)
(Continued)

(52) U.S. Cl.
CPC ..... *B26D 3/22* (2013.01); *B26D 3/18* (2013.01); *B26D 7/0691* (2013.01); *B26D 7/18* (2013.01);
(Continued)

(58) Field of Classification Search
CPC ... B26D 3/22; B26D 1/12; B26D 7/18; B26D 3/26; B26D 9/00; B26D 2007/1809;
(Continued)

(56) References Cited

U.S. PATENT DOCUMENTS 2,541,180 A * 2/1951 Urschel ..... B26D 3/22 83/403
2,603,262 A * 7/1952 Urschel ..... B26D 1/38 83/302
(Continued)

FOREIGN PATENT DOCUMENTS

JP 2004-321744 11/2004
JP 2008-178962 8/2008
(Continued)

OTHER PUBLICATIONS

Anonymous: outboard, adj., adv., and n.: Oxford English Dictionary; Nov. 24, 2016; XP055322686; retrieved from the Internet.
(Continued)

*Primary Examiner* — Ghassem Alie
(74) *Attorney, Agent, or Firm* — Hartman Global IP Law; Gary M. Hartman; Domenica N. S. Hartman

(57) ABSTRACT

Methods and machines for cutting solid and semisolid materials, for example, food products. The machine has a dicing unit that has a feed drum, circular cutter, and cross-cutter each individually rotatably mounted to a support structure by cantilevered shafts. The machine further has a knife for producing slices of a solid or semisolid material, circular knives on the circular cutter to cut the slices into strips, and cross-cut knives on the cross-cutter to dice the strips. The machine also has a stripper plate for removing the strips from the circular cutter, and an outboard support assembly for supporting and radially centering outboard ends of the shafts of the feed drum, circular cutter, and cross-cutter and for supporting and securing the stripper plate relative thereto.

15 Claims, 9 Drawing Sheets

(51) Int. Cl.

| | |
|---|---|
| ***B26D 3/18*** | (2006.01) |
| ***B26D 7/06*** | (2006.01) |
| *B26D 3/26* | (2006.01) |
| *B26D 1/12* | (2006.01) |

(52) U.S. Cl.
CPC ..... *B26D 1/12* (2013.01); *B26D 3/26* (2013.01); *Y10T 29/49815* (2015.01); *Y10T 83/501* (2015.04)

(58) Field of Classification Search
CPC ..... Y10T 83/501; Y10T 29/49815; Y10T 83/2118
USPC ..... 83/356.3; 29/426.1, 428; 241/86.1, 95, 241/101.1, 30, 88.1, 89.3, 89.1, 242, 243
See application file for complete search history.

(56) References Cited

U.S. PATENT DOCUMENTS

| | | | | | |
|---|---|---|---|---|---|
| 3,217,988 | A * | 11/1965 | Lightfoot | B26D 1/38 | 241/101.4 |
| 3,988,953 | A * | 11/1976 | Bosley | B26D 3/22 | 426/518 |
| 4,625,606 | A | 12/1986 | Pinegar et al. | | |
| 4,743,307 | A | 5/1988 | Mason | | |
| 4,782,729 | A | 11/1988 | Mathot | | |
| 4,906,145 | A | 3/1990 | Oliver | | |
| 5,129,299 | A * | 7/1992 | Fischer | B26D 3/22 | 83/121 |
| 5,722,143 | A | 3/1998 | Bucks et al. | | |
| 6,536,691 | B2 * | 3/2003 | Prewitt | A01J 27/04 | 241/101.01 |

FOREIGN PATENT DOCUMENTS

| | | |
|---|---|---|
| JP | 2008-283907 | 11/2008 |
| KR | 10-2004-0083560 | 10/2004 |

OTHER PUBLICATIONS

European Search Report dated Dec. 7, 2016; for European Application No. 14801530.8; PCT/US2014/039372.

* cited by examiner

DICING MACHINES AND METHODS OF USE

CROSS REFERENCE TO RELATED APPLICATIONS

This application claims the benefit of U.S. Provisional Application No. 61/826,585, filed May 23, 2013, the contents of which are incorporated herein by reference.

BACKGROUND OF THE INVENTION

The present invention generally relates to methods and machines for cutting solid and semisolid materials, including food products.

The Affinity® dicer is a machine manufactured by Urschel Laboratories and is particularly well suited for dicing various materials, notable but nonlimiting examples of which include cheeses and meats. The Affinity® dicer is well known as capable of high capacity output and precision cuts. In addition, the Affinity® dicer has a sanitary design to deter bacterial growth.

A nonlimiting representation of an Affinity® dicer is shown in FIG. 1. Product is delivered to a feed hopper (not shown) and enters a rotating impeller 10, where centrifugal forces hold the product against an inner wall of a stationary case 12 equipped with a slicing knife 14. The slicing knife 14 is disposed in an opening in the case 12 and typically oriented approximately parallel to the rotational axis of the impeller 10. Paddles of the impeller 10 carry the product to the slicing knife 14, producing slices that enter a dicing unit of the machine. Specifically, slices pass between a rotating feed drum 16 and feed roll 18, then enter a rotating circular cutter 20 whose axis of rotation is approximately parallel to the rotational axes of the rotating feed drum 16 and feed roll 18. The circular cutter 20 is equipped with circular knives oriented approximately perpendicular to the rotational axis of the circular cutter 20 and, therefore, such that the circular knives cut each slice into strips. The strips pass directly into a rotating cross-cutter 22 whose axis of rotation is approximately parallel to the rotational axis of the circular cutter 20. The cross-cutter 22 is equipped with crosscut knives that are oriented approximately parallel to the rotational axes of the cross-cutter 22, and therefore perpendicular to the circular knives of the circular cutter 20, to produce final cross-cuts that yield a diced product. The rotational speed of the cross-cutter 22 is preferably independently controllable relative to the feed drum 16, feed roll 18 and circular cutter 20 so that the size of the diced product can be selected and controlled.

FIG. 2 schematically represents a longitudinal cross-section of the cross-cutter 22 (not to scale) showing a hollow spindle 24 adapted to be coaxially mounted on a second spindle or shaft (38 in FIG. 3). The hollow spindle 24 defines a circumferential wall 26 in which slots 28 are formed for receiving cross-cut knives 30 of the cross-cutter 22.

FIG. 3 is an exploded view showing individual components of the dicing unit of FIG. 1, including the feed drum 16, feed roll 18, circular cutter 20, and cross-cutter 22 and components associated therewith. As represented in FIG. 3, each of the feed drum 16, feed roll 18, circular cutter 20, and cross-cutter 22 is configured to be individually coaxially mounted on a separate shaft or spindle. In the nonlimiting representation of FIG. 3, the feed drum 16 and cross-cutter 22 are shown as being individually mounted on separate spindle shafts 38 and secured thereto with a retaining washer 40 and nut 42, and the feed roll 18 and circular cutter 20 are shown as being individually mounted on separate spindle shafts 44 and secured thereto with bolts 45. FIG. 3 further represents a stripper or shear plate 32 supported and secured with bolts 36 to a support bar 34. The stripper plate 32 has an upper shear edge 47 adapted to strip products (strips) from the circular cutter 20 prior to being diced with the cross-cutter 22. Slots 46 are defined in a surface of the stripper plate 32 to accommodate the circular knives of the circular cutter 20. The slots 46 extend to the shear edge 47, such that individual edges of the shear edge 47 between adjacent slots 46 are able to remove strips from between adjacent circular knives. A lower shear edge 48 of the stripper plate 32 is in close proximity to the knives 30 of the cross-cutter 22 to ensure complete dicing of the strips delivered from the circular cutter 20 to the cross-cutter 22. The feed drum 16, feed roll 18, circular cutter 20, cross-cutter 22, stripper plate 32, and support bar 34 are all shown as being cantilevered from a support structure 50 of the machine, for example, an enclosure, frame and/or other structures interconnected with the stationary case 12 and including drive systems operable to rotate the impeller 10, feed drum 16, feed roll 18, circular cutter 20, and cross-cutter 22 at the desired rotational speeds thereof.

From the above, it should be apparent that the feed drum 16, feed roll 18, circular cutter 20, cross-cutter 22, stripper plate 32, and support bar 34 must be securely and precisely positioned relative to each other, for example, to ensure that the circular cutter 20, cross-cutter 22 and stripper plate 32 do not move relative to each other to the extent that the circular knives of the circular cutter 20, the cross-cut knives 30 of the cross-cutter 22, and the stripper plate 32 would interfere with each other. As discussed in reference to FIG. 3, the feed drum 16, feed roll 18, circular cutter 20, cross-cutter 22, stripper plate 32, and support bar 34 are all cantilevered from a side of a support structure 50. The cantilevered design shown in FIGS. 1 and 3 promotes sanitation by making the components of the dicing unit readily accessible for cleaning. While completely adequate for many food processing applications, including cheeses for which the Affinity® is widely used, greater rigidity may be desirable when processing significantly harder food products, for example, frozen products.

BRIEF DESCRIPTION OF THE INVENTION

The present invention provides dicing machines and methods that promote the capability of producing diced solid and semisolid materials, particularly in the event that a relatively hard food product is being diced.

According to one aspect of the invention, a machine for cutting food products includes a stationary case surrounding a rotating impeller, a support structure interconnected with the stationary case, and a feed drum, a circular cutter, and a cross-cutter that are each individually rotatably mounted to the support structure by cantilevered shafts. The shafts of the feed drum, the circular cutter, and the cross-cutter each have an outboard end. The machine further includes a knife for producing slices by slicing a solid or semisolid material exiting through the stationary case under the influence of the impeller, circular knives on the circular cutter that are adapted and arranged to cut into strips the slices produced by the knife, and cross-cut knives on the cross-cutter that are adapted and arranged to dice the strips produced by the circular knives. The machine also includes a stripper plate having a first edge between the circular cutter and the cross-cutter for removing the strips from the circular cutter, and outboard support means for supporting and radially centering the outboard ends of the shafts of at least the feed drum, the circular cutter, and the cross-cutter and for supporting and securing the stripper plate relative thereto.

According to another aspect of the invention, a machine for cutting food products includes a stationary case surrounding a rotating impeller, a support structure interconnected with the stationary case, and a feed drum, a circular cutter, and a cross-cutter that are each individually rotatably mounted to the support structure by cantilevered shafts. The shafts of the feed drum, the circular cutter, and the cross-cutter each have an outboard end. The machine further includes a knife for producing slices by slicing a solid or semisolid material exiting through the stationary case under the influence of the impeller, circular knives on the circular cutter that are adapted and arranged to cut into strips the slices produced by the knife, and cross-cut knives on the cross-cutter that are adapted and arranged to dice the strips produced by the circular knives. The machine also includes a stripper plate having a first edge between the circular cutter and the cross-cutter for removing the strips from the circular cutter, and slots that extend to the first edge of the stripper plate wherein individual edges of the first edge between adjacent pairs of the slots remove the strips from between adjacent pairs of the circular knives. The stripper plate also has a second edge adapted to ensure complete dicing of the strips by the cross-cut knives of the cross-cutter, and means is provided for adjusting the placement and proximity of the second edge relative to the cross-cut knives. The machine also includes outboard support means for supporting and radially centering the outboard ends of the shafts of at least the feed drum, the circular cutter, and the cross-cutter and for supporting and securing the stripper plate relative thereto.

Other aspects of the invention include methods of using a machine comprising elements such as those described above. A particular but nonlimiting example is a method that entails installing the outboard support means on, and then subsequently removing the outboard support means from, a dicing machine as a complete unit and independently of the feed drum, the circular cutter, and the cross-cutter.

A technical effect of the invention is the ability to increase the rigidity of the circular cutter, cross-cutter and stripper plate to permit greater precision with respect to the placement and proximity of the second edge of the stripper plate relative to the cross-cut knives of the cross-cutter, which is desirable when processing relatively hard solid materials, for example, frozen food products.

Other aspects and advantages of this invention will be better appreciated from the following detailed description.

DETAILED DESCRIPTION OF THE INVENTION

Figure 1:
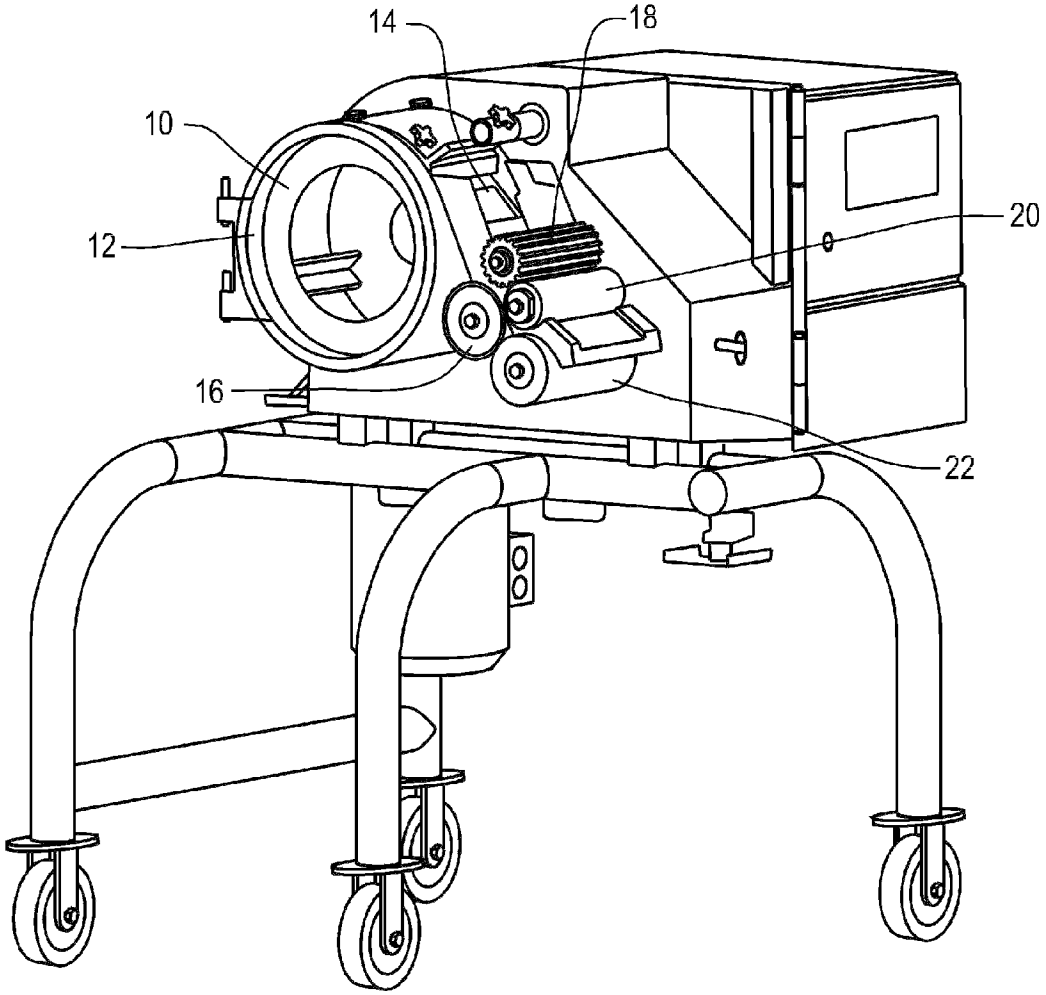
FIG. 1 (Prior Art)
FIG. 1 schematically represents an example of an Affinity® dicer machine.

FIG. 4 through 9 depict a dicing unit installed on a dicing machine, for example, the Affinity® dicer represented in FIG. 1. The dicing unit is adapted to produce cross-cuts in a sliced product to achieve a dicing effect and produce a diced product, though those skilled in the art will appreciate that the dicing unit and its benefits are not limited to such uses nor limited to the Affinity® dicer.

Figure 2:
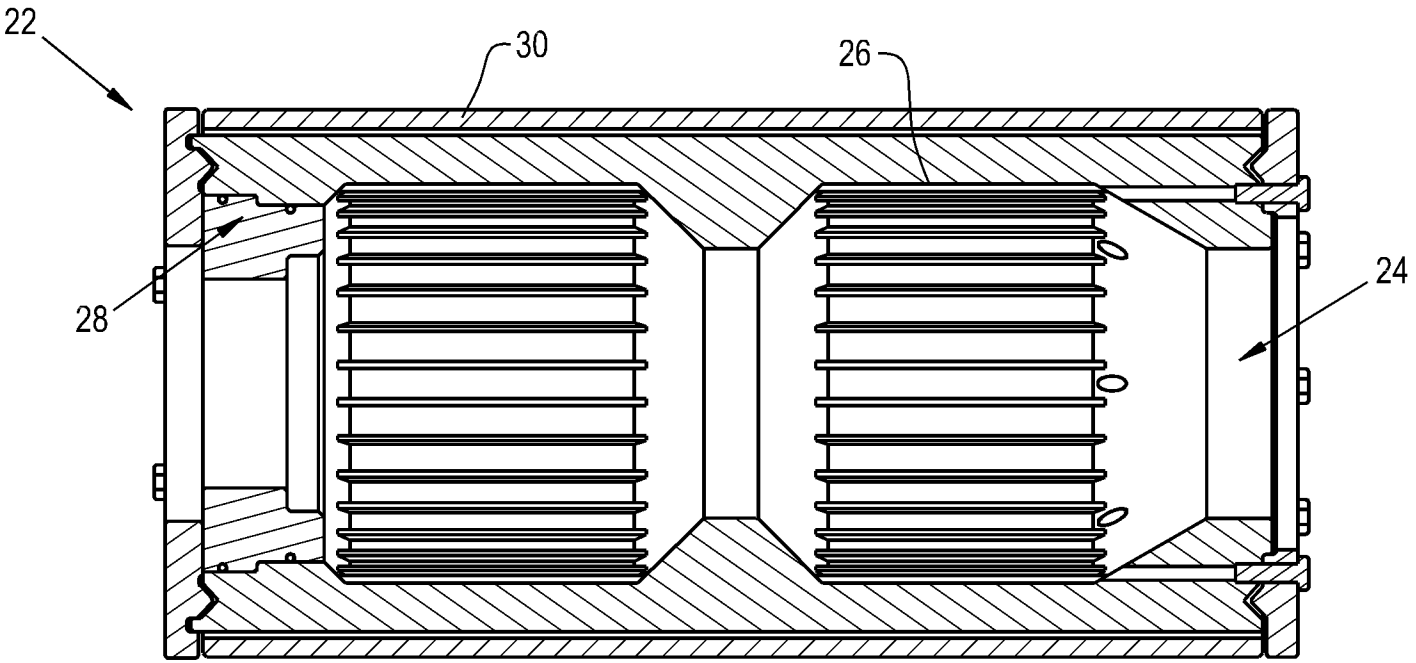
(Prior Art) Fig. 2
FIG. 2 represents a fragmentary longitudinal cross-sectional view of a cross-cutter of the Affinity® dicer machine of FIG. 1.
Figure 3:
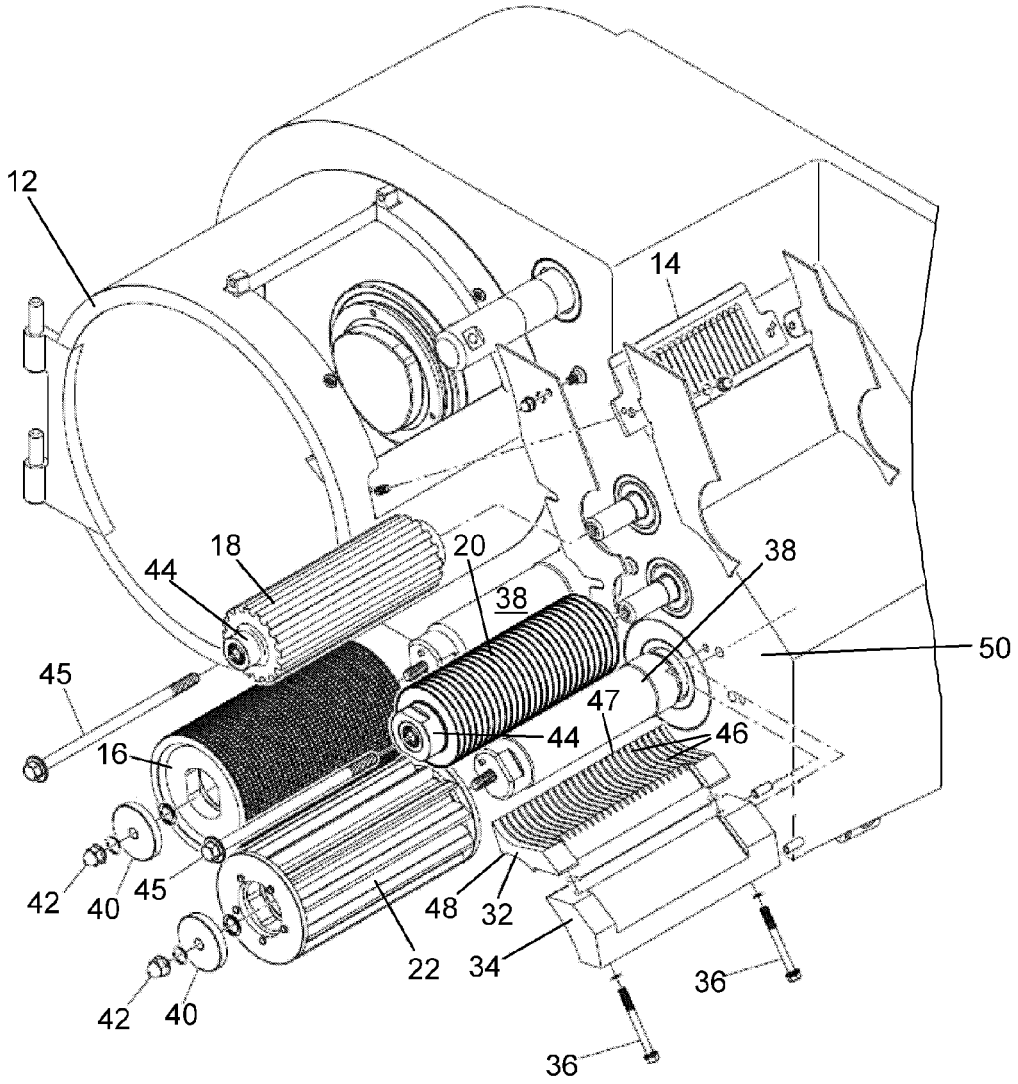
FIG. 3 (Prior Art)
FIG. 3 represents a fragmentary exploded view of a dicing unit of the Affinity® dicer machine of FIG. 1.
Figure 4:
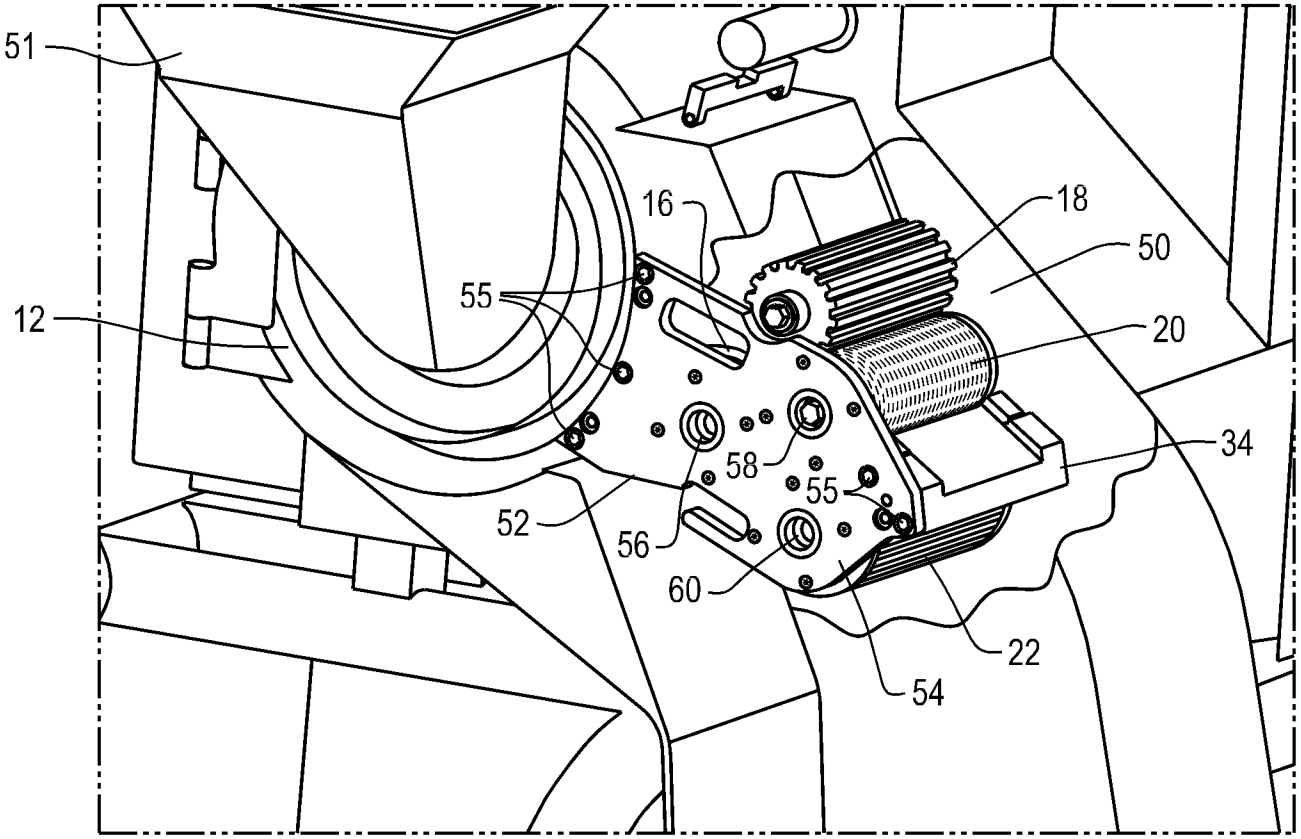
FIG. 4 represents a fragmentary perspective view of a dicing unit installed on a dicing machine, for example, the Affinity® dicer machine of FIG. 1.

As represented in FIG. 4, the dicing unit comprises components similar to that of the Affinity® dicer of FIGS. 1 through 3. Furthermore, in the nonlimiting embodiment represented in FIGS. 4 through 9, the dicing unit is configured to be adapted for use with the Affinity® dicer of FIGS. 1 through 3, possibly as a retrofit for the Affinity® dicer, in that the dicing unit primarily comprises components that can be additional to or substituted for components shown in FIG. 1 through 3. However, it should be appreciated that the dicing unit could also be provided as original equipment on a dicing machine. Because of the similarities between the dicing unit of FIGS. 4 through 9 and the dicing unit of FIGS. 1 through 3, the following discussion of FIGS. 4 through 9 will focus primarily on aspects of the dicing unit of FIGS. 4 through 9 that differ from the dicing unit of FIGS. 1 through 3 in some notable or significant manner. Other aspects of the dicing unit of FIGS. 4 through 9 not discussed in any detail can be, in terms of structure, function, materials, etc., essentially as was described for the dicing unit of FIGS. 1 through 3. Furthermore, consistent reference numbers are used throughout the figures to identify the same or functionally equivalent elements.

The dicing unit is depicted in FIG. 4 from a perspective view similar to that of FIG. 1. In the nonlimiting embodiment of FIG. 4, solid and semisolid materials, for example, food products, are delivered to an impeller (not shown, but corresponding to the impeller 10 of FIG. 1) through a hopper 51 mounted to the stationary case 12 surrounding and containing the impeller. According to one aspect of the invention, the dicing unit of FIGS. 4 through 9 differs from that shown in FIGS. 1 and 3 by including an outboard support means adapted to support the outboard ends of the otherwise cantilevered feed drum 16, circular cutter 20, cross-cutter 22, stripper plate 32, and support bar 34 attached to and projecting from one side of the support structure 50. The nonlimiting embodiment of the outboard support means represented in FIGS. 4 through 9 comprises an outboard bearing assembly 52 that includes a plate 54 secured at one end to the stationary case 12, and at an opposite end to the support bar 34, with the feed drum 16, circular cutter 20, cross-cutter 22, and stripper plate 32 located and rigidly supported therebetween. The plate 54 can be secured to the case 12 and support bar 34 with bolts 55. While the plate 54 is represented as formed as a single unitary piece, it is foreseeable that the plate 54 could be an assembly of separate pieces. In some instances the case 12 and/or support bar 34 may require a modification to enable the plate 54 to be attached thereto, particularly if the outboard bearing assembly 52 is installed as a retrofit on an existing machine. Other locations and various means for securing the plate 54 to the machine are also within the scope of the invention. The outboard bearing assembly 52 is preferably configured as a removable unit to allow the machine and its dicing unit to be operated with or without the assembly 52. In this manner, the machine can be operated without the assembly 52 when used to process products that do not require the additional rigidity provided by the assembly 52, for example, semisolid food products such as cheese and certain solid food products such as meat. In addition, the assembly 52 represented in FIGS. 4 through 9 can preferably be removed as a complete unit so that the dicing unit and its components are readily accessible for cleaning.

Figure 5:
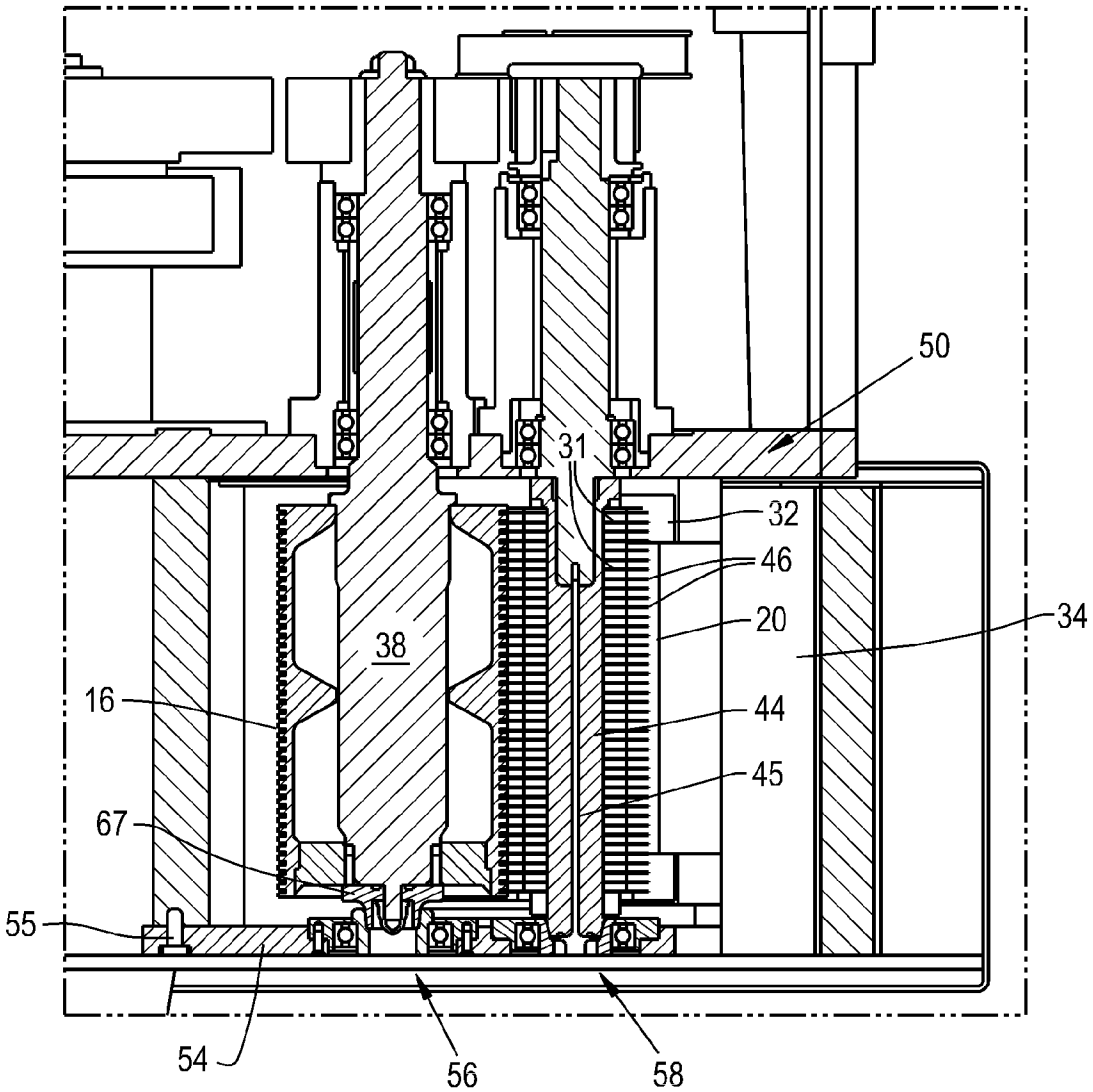
FIG. 5 is a fragmentary top view of the dicing unit of FIG. 4, and shows a feed drum, circular cutter, and adjacent components in longitudinal cross-section.
Figure 6:
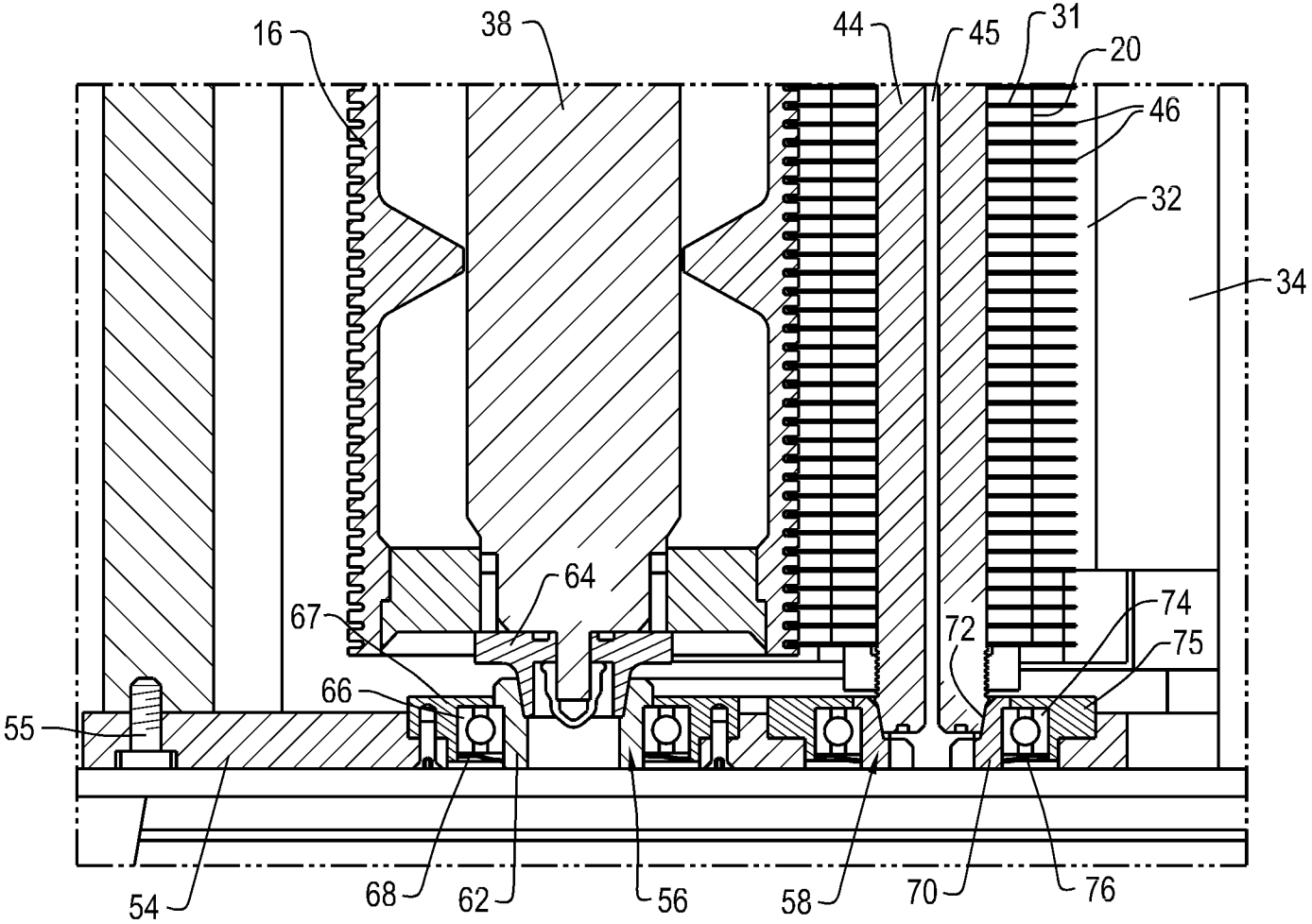
FIG. 6 is a more detailed top view of outboard regions of the feed drum and circular cutter in FIG. 5.
Figure 7:
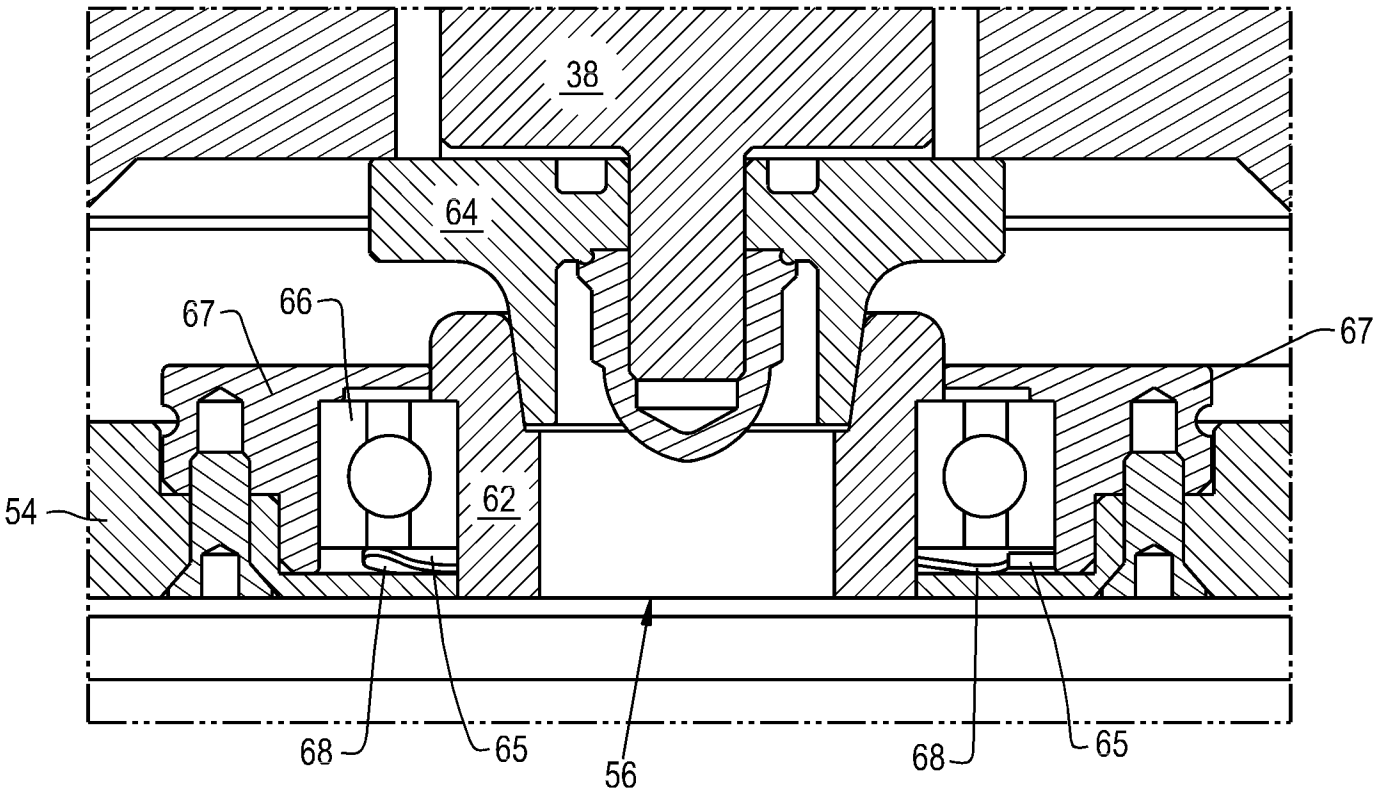
FIG. 7 is a further detailed top view of the outboard region of the feed drum of FIGS. 5 and 6.

The outboard bearing assembly 52 comprises means in the form of support subassemblies or units 56, 58 and 60 for centering and rotatably supporting the outboard ends of at least the feed drum 16, circular cutter 20, and cross-cutter 22. Particular but nonlimiting embodiments for the support units 56 and 58 for the feed drum 16 and circular cutter 20 are shown in more detail in FIGS. 5, 6 and 7. For use with a dicing unit of the type represented in FIG. 3, the support unit 60 for the cross-cutter 22 may be similar to what is represented for the support unit 56, and therefore is not shown in further detail. In FIGS. 5, 6 and 7, the support unit 56 for the outboard end of the feed drum 16 comprises a tapered cup 62 having internal (female) sloping walls that are complementary to external (male) sloping walls defined at an outboard end of the spindle shaft 38 of the feed drum 16. In the embodiment shown in FIGS. 6 and 7, the external sloping walls can be seen as defined by a fitting 64 secured to the end of the spindle shaft 38, though it is foreseeable that the end of the spindle shaft 38 could be formed to have similar external sloping walls. The complementary tapers of the cup 62 and fitting 64 ensure centering of the spindle shaft 38 and accommodate radial tolerances. The cup 62 is supported by a bearing 66 that is secured to the plate 54, for example, in a pocket 65 within the plate 54 and defined by and between the cup 62 and a retainer plate 67, as most readily apparent from FIG. 7. The pocket 65 is sized to allow axial movement of the bearing 66, and a spring 68 within the pocket 65 axially biases the bearing 66 and cup 62 into engagement with the fitting 64 of the feed drum 16 to ensure axial tolerances are also accommodated.

FIGS. 5 and 6 depict a similar arrangement for the support unit 58 of the circular cutter 20. The support unit 58 is represented as comprising a tapered cup 70 having internal (female) sloping walls that are complementary to external (male) sloping walls defined at the outboard end 72 of the spindle shaft 44 of the circular cutter 20. Alternatively, it is foreseeable that a fitting similar to those of the spindle shafts 38 could be secured to the end of the spindle shaft 44 to define the external sloping walls. The complementary tapers of the cup 70 and outboard end 72 ensure centering of the spindle shaft 44 and accommodate radial tolerances. The cup 70 is supported by a bearing 74 that is secured to the plate 54 in a manner similar to the support unit 56 of the feed drum 16, for example, in a pocket within the plate 54 and defined by and between the cup 70 and a retainer plate 75 to allow axial movement of the bearing 74. A spring 76 axially biases the bearing 74 and cup 70 into engagement with the outboard end 72 of the spindle shaft 44 to ensure axial tolerances are also accommodated.

Figure 9:
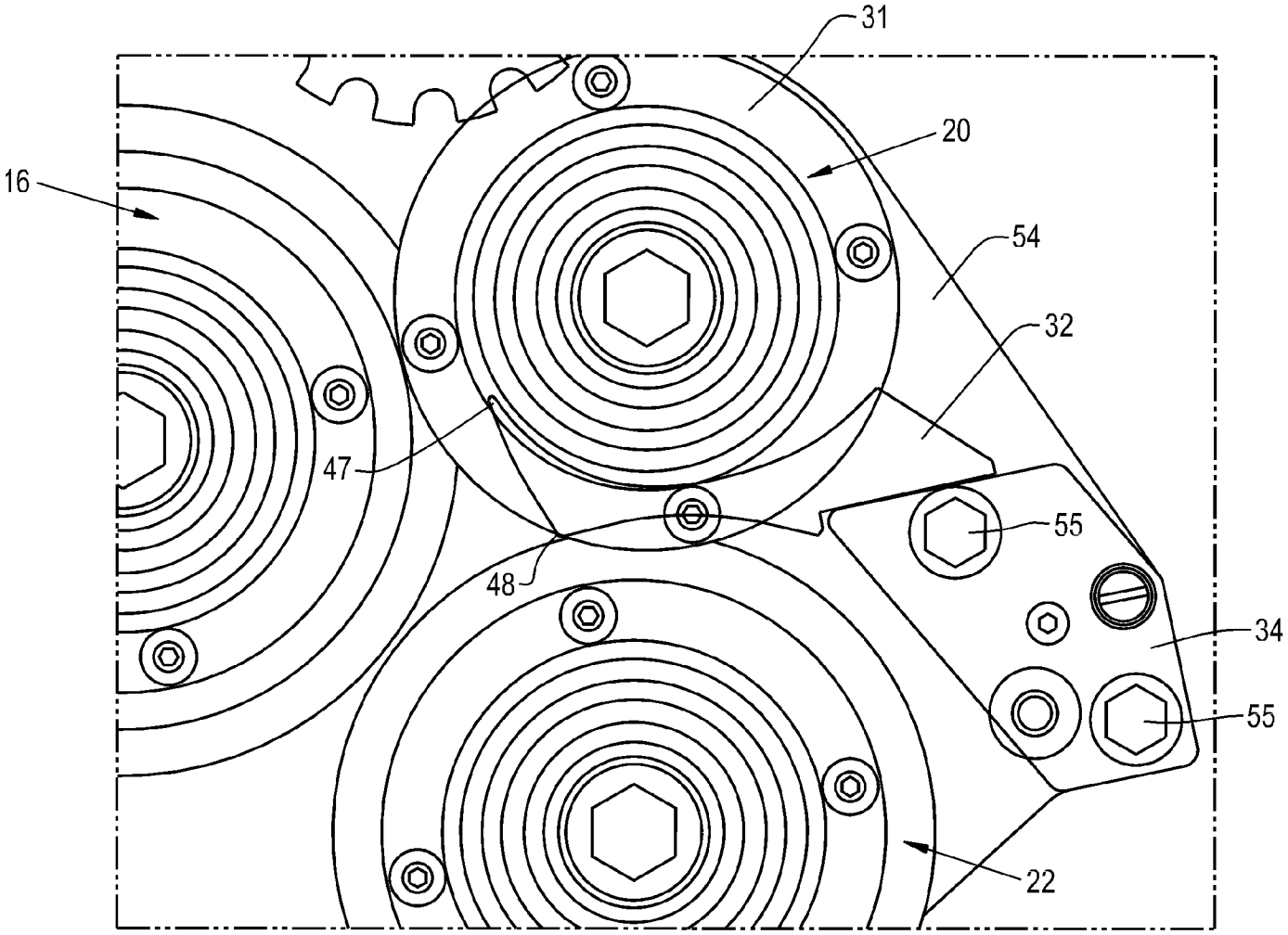
FIG. 9 is an end view of the dicing unit of FIG. 4, showing outboard ends of the feed drum, circular cutter, and stripper assembly as well as an outboard end of a cross-cutter of the dicing unit.

As previously noted, the outboard end of the support bar 34 is secured to the plate 54 of the outboard bearing assembly 52, with the result that the rigidity of the support bar 34 and the stripper plate 32 are also increased relative to the machine represented in FIGS. 1 through 3. This aspect of the invention is important in view of the function of the stripper plate 32, which requires accurate positioning relative to the circular cutter 20 and cross-cutter 22 in order to strip products (strips) from the circular cutter 20 and its circular knives 31 prior to the strips being diced by the cross-cut knives 30 of the cross-cutter 22. As evident from FIGS. 5 and 6, the slots 46 in the stripper plate 32 individually accommodate the circular knives 31 of the circular cutter 20, so that individual edges of the upper shear edge 47 between adjacent slots 46 remove strips from between adjacent circular knives 31. Furthermore, as evident from FIG. 9, the lower shear edge 48 of the stripper plate 32 is in close proximity to the knives 30 of the cross-cutter 22 to ensure complete dicing of the strips received from the circular cutter 20. The increased rigidity of the support bar 34 and stripper plate 32 permits greater precision with respect to the placement and proximity of the stripper plate slots 46 and the individual edges of the upper shear edge 47 relative to the circular cutter knives 31 of the circular cutter 20 (FIGS. 5 and 6) and the placement and proximity of the lower shear edge 48 relative to the cross-cut knives 30 of the cross-cutter 22 (FIG. 9).

Figure 8:
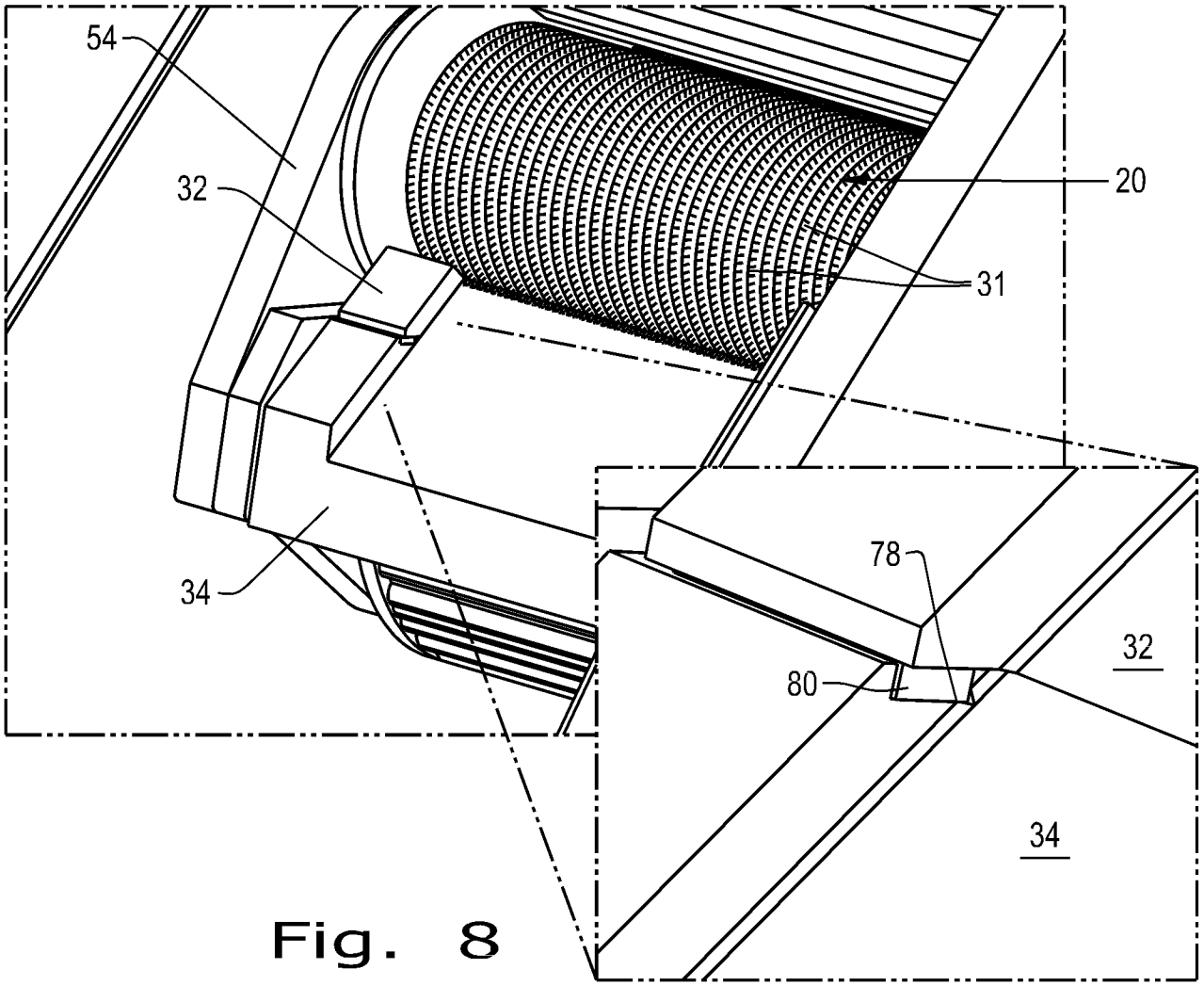
FIG. 8 contains a fragmentary perspective view of a stripper assembly of the dicing unit of FIG. 4, and further contains an inset view of an adjustable feature of the stripper assembly.

To enable adjustment of the distance between the shear edge 48 and cross-cut knives 30, FIG. 8 represents a slot 78 (or other suitable form of recess) defined between the stripper plate 32 and support bar 34, and a shim 80 received in the slot 78 and having a cross-section complementary to the slot 78. The shim 80 may be one of any number of shims that are thicker than the depth of the slot 78 to cause the stripper plate 32 to tilt relative to the support bar 34. As evident from FIG. 9, increasingly thicker shims 80 result in increased tilting of the stripper plate 32, causing the shear edge 48 of the stripper plate 32 to move toward the cross-cutter 22, thus reducing the distance between the shear edge 48 and the knives 30 of the cross-cutter 22. In the embodiment of FIG. 9, shimming the stripper plate 32 about 0.001 inch (about 25 micrometers) can result in a movement of about 0.002 inch (about 50 micrometers) at the shear edge 48 of the stripper plate 32. Without the additional rigidity of the dicing unit contributed by the plate 54, the closer proximity of the shear edge 48 to the knives 30 could possibly result in interference therebetween, particularly if hard solid materials (e.g., frozen food products) are being diced.

From the above, it should be apparent that the feed drum 16, feed roll 18, circular cutter 20, cross-cutter 22, stripper plate 32, and support bar 34 are securely and precisely positioned relative to each other with the outboard bearing assembly 52, which is intended to ensure that the circular cutter 20, cross-cutter 22 and stripper plate 32 do not move toward or away from each other during a dicing operation. The manner in which the spindle shafts 38 and 44 of the feed drum 16, circular cutter 20 and cross-cutter 22 are supported by the support units 56, 58 and 60 of the assembly 52 preferably does not alter the capability of independently controlling the rotational speed of the cross-cutter 22 relative to the feed drum 16, feed roll 18 and circular cutter 20 so that the size of the diced product can be selected and controlled.

While the invention has been described in terms of a specific embodiment, it is apparent that other forms could be adopted by one skilled in the art. For example, the physical configuration of the dicing unit and its components could differ from that shown, and various materials and processes could be used to manufacture the dicing unit and its components. Therefore, the scope of the invention is to be limited only by the following claims.

The invention claimed is:

1. A machine for dicing solid and semisolid materials, the machine comprising:

a support structure;

means interconnected with the support structure for producing slices by slicing a solid or semisolid material;

a circular cutter and a cross-cutter that are each individually rotatably mounted to the support structure by cantilevered shafts, the shafts of the circular cutter and the cross-cutter each having an outboard end;

circular knives on the circular cutter that are adapted and arranged to cut into strips the slices produced by the slice-producing means;

cross-cut knives on the cross-cutter that are adapted and arranged to dice the strips produced by the circular knives;

a stripper plate having a first edge between the circular cutter and the cross-cutter for removing the strips from the circular cutter, the stripper plate defining a second edge adapted to ensure complete dicing of the strips by the cross-cut knives of the cross-cutter;

means for adjusting the placement and proximity of the second edge relative to the cross-cut knives, said adjusting means comprises shimming means; and outboard support means for supporting and radially centering the outboard ends of the shafts of at least the circular cutter and the cross-cutter and for supporting and securing the stripper plate relative thereto.

2. The machine of claim 1, wherein the stripper plate comprises slots that extend to the first edge, and individual edges of the first edge between adjacent pairs of the slots remove the strips from between adjacent pairs of the circular knives.

3. The machine of claim 1, wherein the stripper plate is secured to a support bar and the adjusting means tilts the stripper plate relative to the support bar.

4. The machine of claim 3, wherein the adjusting means comprises at least a first removable shim between the stripper plate and the support bar.

5. The machine of claim 4, wherein the first removable shim is disposed between the stripper plate and the support bar so as to tilt the stripper plate relative to the support bar and thereby cause the second edge of the stripper plate to move toward the cross-cutter and reduce a distance between the second edge and the cross-cut knives of the cross-cutter.

6. The machine of claim 5, wherein the adjusting means further comprises a second removable shim the shim adapted to be disposed between the stripper plate and the support bar so as increase the tilt the stripper plate relative to the support bar.

7. The machine of claim 5, wherein the adjusting means further comprises a recess defined by at least one of the stripper plate and the support bar and in which the first removable shim is disposed.

8. The machine of claim 1, wherein the stripper plate is secured to a support bar, the support bar is secured and cantilevered from the support structure, and the outboard support means comprises a support plate secured to an outboard end of the support bar.

9. The machine of claim 8, wherein the outboard support means further comprises cups mounted to the support plate, and the cups have female tapered features engaged with complementary male tapered features associated with the shafts of the circular cutter and the cross-cutter so as to support and radially center the shafts of the circular cutter and the cross-cutter.

10. The machine of claim 9, wherein the outboard support means, the support plate thereof, and the cups mounted thereto are installed on the machine and removable from the machine as a complete unit.

11. The machine of claim 10, wherein at least the circular cutter and the cross-cutter are mounted to the support structure such that removal of the outboard support means from the machine results in at least the circular cutter and the cross-cutter being cantilevered from the support structure.

12. The machine of claim 1, wherein the solid or semisolid material is a food product.

13. The machine of claim 1, wherein the solid or semisolid material is a solid frozen food product.

14. A method of using the machine of claim 1, the method comprising installing the outboard support means on and removing the outboard support means from the machine as a complete unit and independently of the circular cutter and the cross-cutter.

15. The method of claim 14, wherein the outboard support means comprises a support plate, the stripper plate is secured to a support bar that is secured and cantilevered from the support structure, and the step of installing the outboard support means on the machine comprises securing the support plate to an outboard end of the support bar.

* * * * *